US006895704B2

(12) United States Patent
Ives et al.

(10) Patent No.: US 6,895,704 B2
(45) Date of Patent: May 24, 2005

(54) WORK BOARD ASSEMBLY

(75) Inventors: Josiah M. Ives, Kalona, IA (US); Mark Schaefers, Muscatine, IA (US); Robert J. Glenn, II, Chicago, IL (US); Shawn O. Barrett, Des Plaines, IL (US); William C. Cesaroni, Glenview, IL (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/712,225

(22) Filed: Nov. 13, 2003

(65) Prior Publication Data

US 2004/0148835 A1 Aug. 5, 2004

Related U.S. Application Data

(62) Division of application No. 10/355,884, filed on Jan. 31, 2003, now abandoned.

(51) Int. Cl.[7] ..... G09F 11/02

(52) U.S. Cl. ..... 40/493; 40/606.15; 40/616.18; 40/617; 434/408; 434/414; 434/415; 434/421; 16/87 R

(58) Field of Search ..... 40/491, 492, 493, 40/508, 606.14, 606.15, 606.18, 611.01, 611.02, 617; 434/408, 414, 415, 421; 16/87 R; 248/339

(56) References Cited

U.S. PATENT DOCUMENTS

| | | | | | |
|---|---|---|---|---|---|
| 1,621,262 | A | * | 3/1927 | MacQuarrie | 434/416 |
| 2,048,845 | A | * | 7/1936 | Danley | 16/87 R |
| 2,655,740 | A | * | 10/1953 | Goodrich | 434/414 |
| 2,825,152 | A | * | 3/1958 | Baylon | 434/430 |
| 4,067,537 | A | * | 1/1978 | Pejrud | 248/476 |
| 4,239,170 | A | * | 12/1980 | Planebo | 248/447.1 |
| 5,161,321 | A | * | 11/1992 | Kuhnke | 40/493 |
| 5,176,522 | A | * | 1/1993 | Robertson, Jr. | 434/415 |
| 6,139,331 | A | * | 10/2000 | Owen | 434/408 |
| 6,272,779 | B1 | * | 8/2001 | Seiber et al. | 40/607.14 |
| 6,328,571 | B1 | * | 12/2001 | Dricken et al. | 434/408 |
| 6,449,909 | B1 | * | 9/2002 | Baloga et al. | 52/36.1 |

* cited by examiner

*Primary Examiner*—Gary C. Hoge
(74) *Attorney, Agent, or Firm*—Ronald A. Sandler; Jones Day

(57) ABSTRACT

A work board assembly having a board and hook assembly mountable to a rail assembly, and the rail assembly is mountable to a wall. A flip chart holder may optionally be hung on the board to add versatility to the board. The hook assembly is rotatable, thereby allowing opposite surfaces of the board to be easily and quickly exposed. The exposed surfaces may accept markers or the surfaces may allow tacking of documents, or one surface may be for markers and the other for tacking. The rail assembly includes a bracket designed to be attached to a wall and to mount a rotatable cam. The cam is received by a rail and rotation of the cam causes locking engagement of the rail to the bracket.

30 Claims, 11 Drawing Sheets

WORK BOARD ASSEMBLY

CROSS REFERENCE TO RELATED APPLICATIONS

The present application is a divisional of application Ser. No. 10/355,884, entitled "Versatile Work Board System", filed on Jan. 31, 2003 now abandoned.

STATEMENT RE FEDERALLY SPONSORED RESEARCH

Not applicable

BACKGROUND OF THE INVENTION

1. Field of the Invention

The present invention relates to a work board assembly and more particularly to a work board assembly which is simple and versatile.

2. Description of the Related Art

Marker boards, tack boards and flip charts are all well known devices for communicating in a workplace. See for example, U.S. Pat. Nos. 5,518,217; 5,152,490; 4,258,893; 4,239,170; and 3,975,837. Unfortunately, none of the prior related art offers the versatility, simplicity and ease of use needed in present day office environments.

BRIEF SUMMARY OF THE INVENTION

The lack of versatility offered by previous devices has been overcome by the present invention. What is described here is a work board assembly comprising a board having front and rear surfaces, and a hook assembly including a bracket attached to the board and a hook rotatably mounted to the bracket.

There are a number of advantages, features and objects achieved with the present invention which are believed not to be available in earlier related devices. For example, the work board assembly disclosed herein is extremely versatile, simple, reliable and easy to use. The work board is also relatively inexpensive.

A more complete understanding of the present invention and other objects, advantages and features thereof will be gained from a consideration of the following description of preferred embodiments read in conjunction with the accompanying drawing provided herein. The preferred embodiments represent examples of the invention which is described here in compliance with Title 35 U.S.C. section 112 (first paragraph), but the invention itself is defined by the attached claims.

DETAILED DESCRIPTION OF PREFERRED EMBODIMENTS OF THE INVENTION

Figure 1:
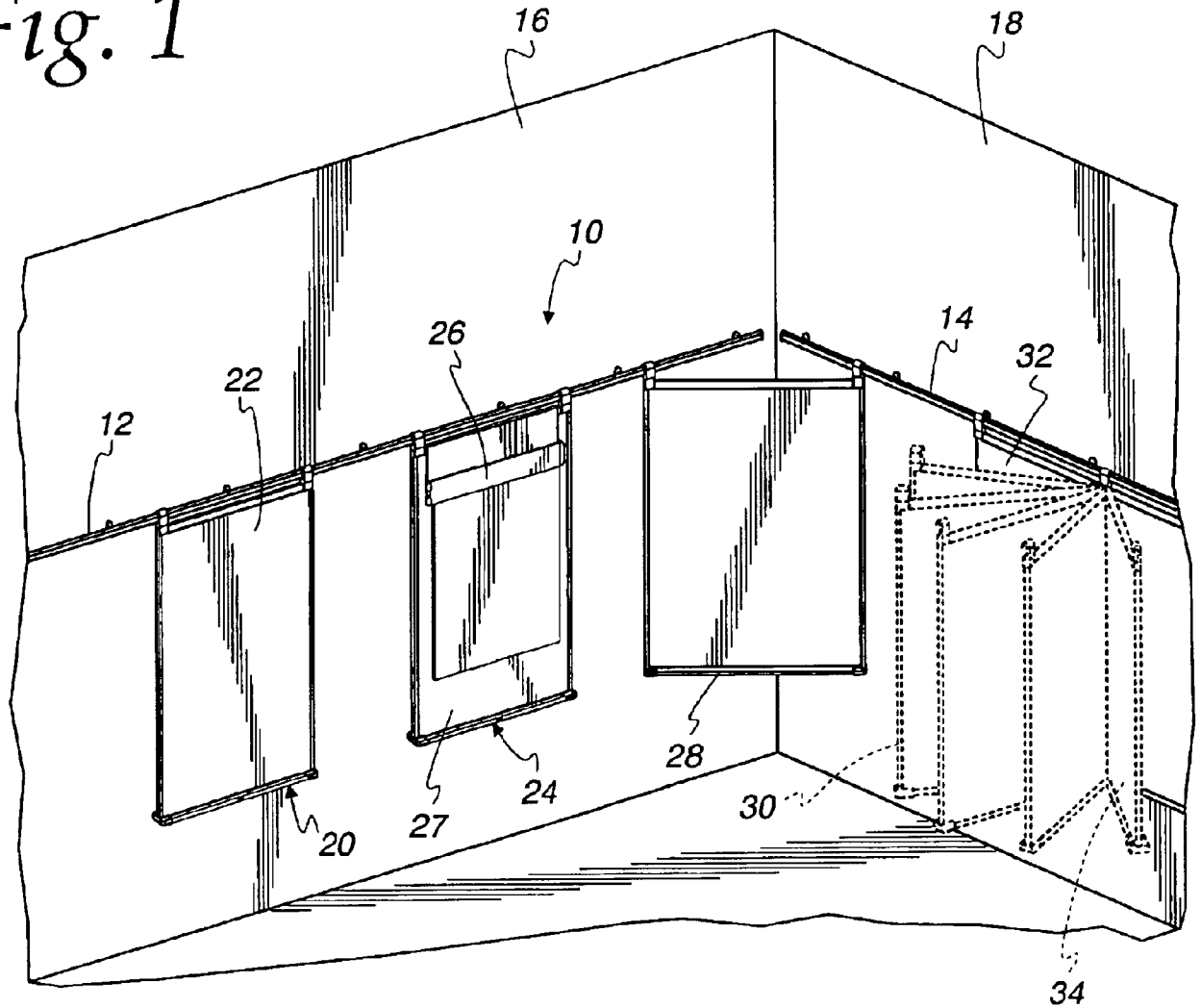
FIG. 1 is a diagrammatic isometric view of a portion of a room illustrating several embodiments of a work board assembly.

While the present invention is open to various modifications and alternative constructions, the preferred embodiments shown in the various figures of the drawing will be described herein in detail. It is understood, however, that there is no intention to limit the invention to the particular embodiments, forms or examples disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Referring now to FIG. 1, there is illustrated the versatile work board system 10 in several embodiments which highlight the versatility of the system. Two rail assemblies 12, 14 are mounted to a first wall 16 and a second wall 18, respectively, of a conference room 19. The first board and hook assembly 20 shows the board and hook assembly mounted in an operative position on the rail assembly 12 so that a front surface 22 is exposed. A user of the board may use the front surface for writing or drawing purposes or, if the board is a tack board, a user may use the front surface to hang one or more sheets of paper.

A second board and hook assembly 24 includes a flip chart 26 mounted over the front surface 27 of the board.

A third board and hook assembly 28 is illustrated straddling both rail assemblies 12, 14 allowing the board and hook assembly to be placed in a corner of the room where the two walls 16, 18 intersect.

A fourth embodiment of the board and hook assembly 30 is illustrated partially in broken line to show how the board may be swiveled or rotated one hundred and eighty degrees from an exposure of a front surface 32 to the exposure of a rear surface 34. This is accomplished simply by removing one hook assembly from the rail assembly and rotating the other hook assembly. This operation will be explained in more detail hereinbelow.

Figure 2:
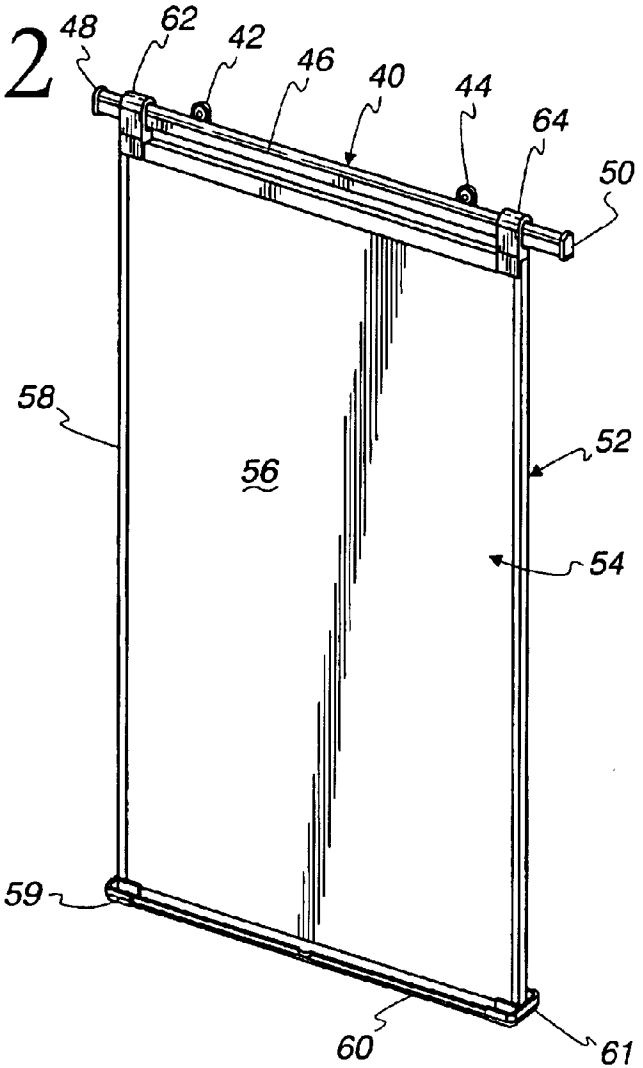
FIG. 2 is an isometric view of a work board assembly including a board, a hook assembly on a rail assembly.
Figure 6:
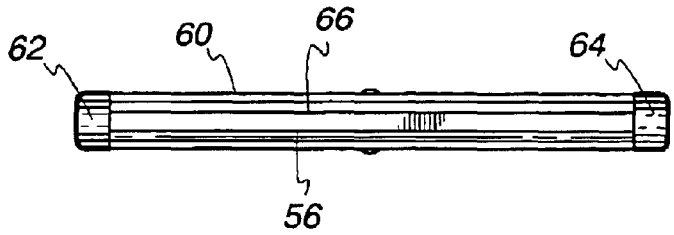
FIG. 6 is a top plan view of the board and hook assembly shown in FIGS. 3–5.

The structural simplicity of the work board system is illustrated in FIG. 2. The system includes a rail assembly 40 shown in more detail. The rail assembly includes two rail hanger brackets 42, 44, a rail 46 and two rail end caps 48, 50. The system also includes a work board assembly 52 having a central panel 54 with a front surface 56. Formed around the panel is a frame 58, and a tray 60 with connector end pieces 59, 61 is mounted to a lower portion of the panel. The board assembly 52 is suspended from the rail assembly 40 by two hook assemblies 62, 64.

Referring now to FIGS. 3–7, the work board assembly includes a panel with the front surface 56 as well as a rear surface 66. The front and rear surfaces may be identical to one another. It should be noted that the tray 60 extends outwardly from the panel in front and rear directions so that markers, chalk or the like may be deposited in the tray on either or both sides of the board. The frame 58 includes left and right vertical members 68, 70, a top horizontal member 72 and the tray 60. As may be appreciated, the hook assemblies 62, 64 are fastened to the top frame member 72. The board may be made of synthetic resin material or tackable material or both. The frame and tray may be made of aluminum and the connector end pieces may be made of synthetic resin.

Figure 4:
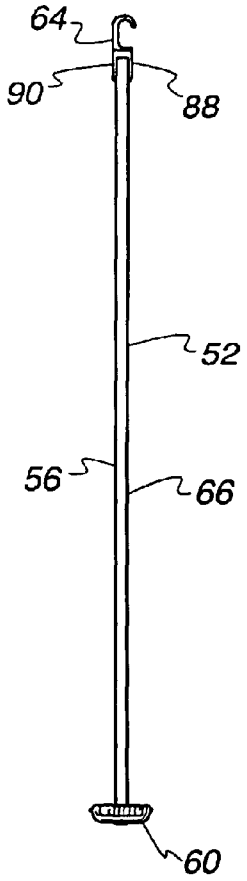
FIG. 4 is a side elevation view of the board and hook assembly shown in FIG. 3.
Figure 8:
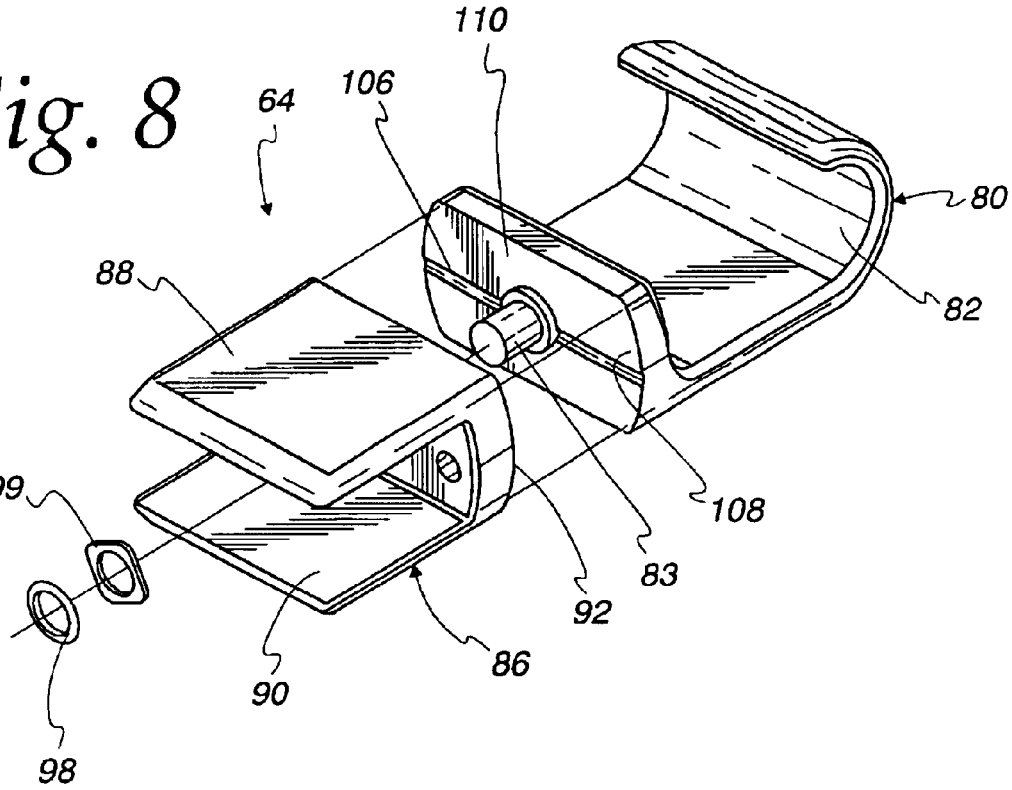
FIG. 8 is an upward looking, exploded isometric view illustrating the hook assembly.
Figure 9:
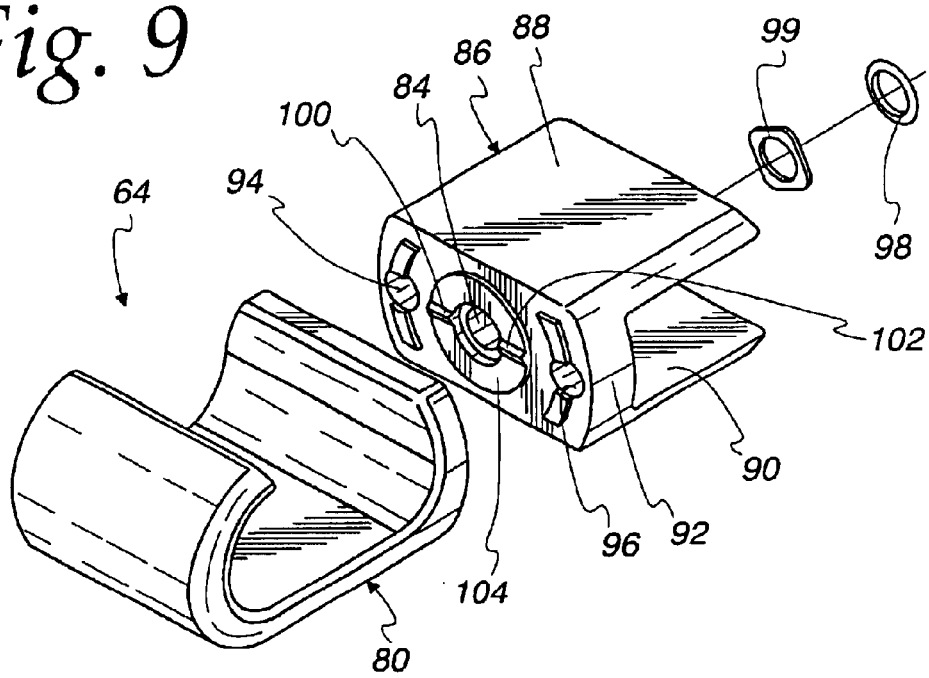
FIG. 9 is a downward looking, exploded isometric view of the hook assembly shown in FIG. 9.
Figure 10:
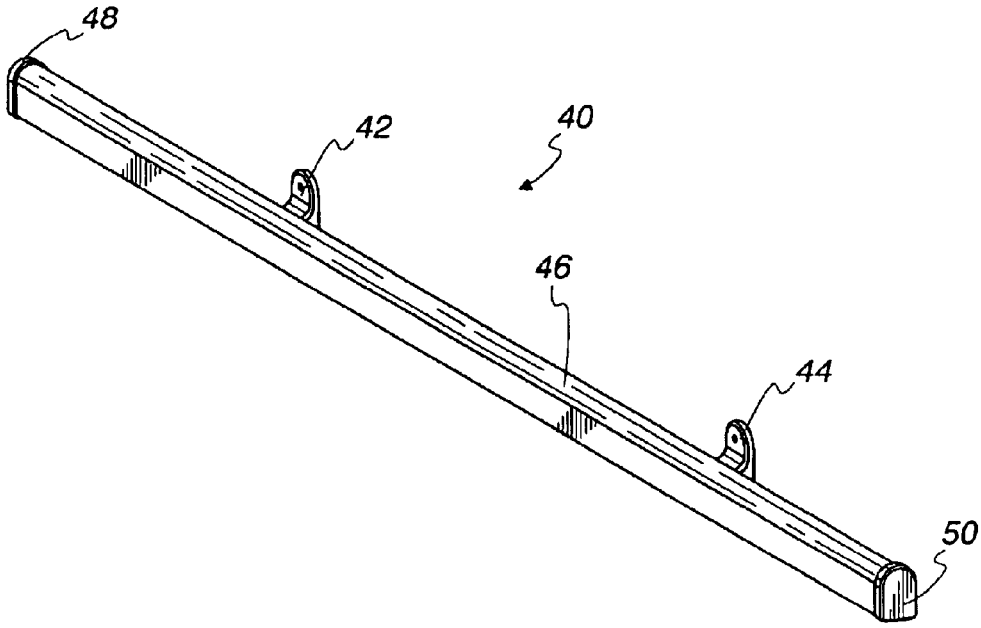
FIG. 10 is a downward looking isometric view of the rail assembly.
Figure 11:
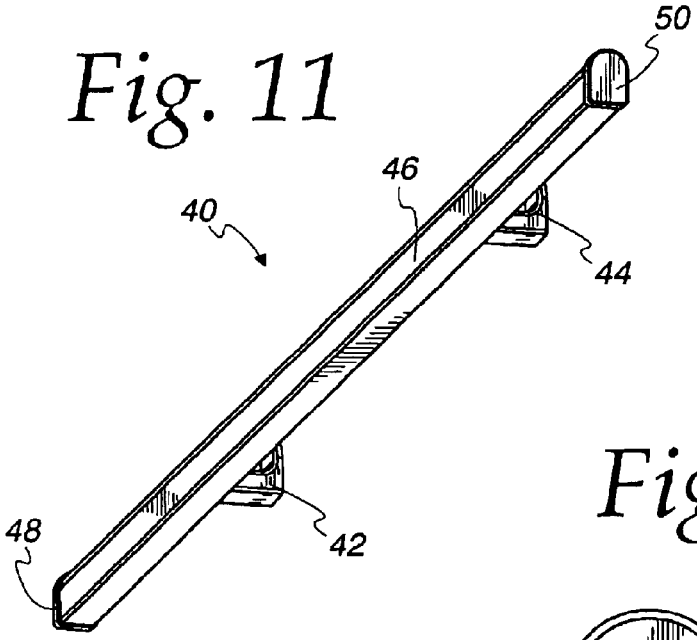
FIG. 11 is an upward looking isometric view of the rail assembly illustrated in FIG. 10.

The hook assembly 64, FIGS. 8 and 9, includes three parts, a hook 80 having a generally C-shaped cross section with an inner surface 82 having a shape generally complementing the shape of the outer surface of the rail 46. Projecting from the bottom of the hook is a post 83 which is received through a central opening 84 in a board bracket 86. The board bracket is generally U-shaped including two arms 88, 90 and a base 92. As shown in FIG. 4, the two arms 88, 90 straddle the board. The base 92 of the board bracket includes two fastener openings 94, 96 which may be used when attaching the board bracket to the top and side members of the board frame. A push nut 98 and a spring washer 99 engage the post 83 from the opposite side of the base 92 of the bracket. The arrangement allows the hook 80 to lift slightly away from the bracket and be rotated about the central axis of the post thereby allowing the attached board to rotate. Rotation allows exposure of both the front and the rear board surfaces as desired by the user. When force on the hook is released, the hook returns to an abutting position against the bracket.

Figure 3:
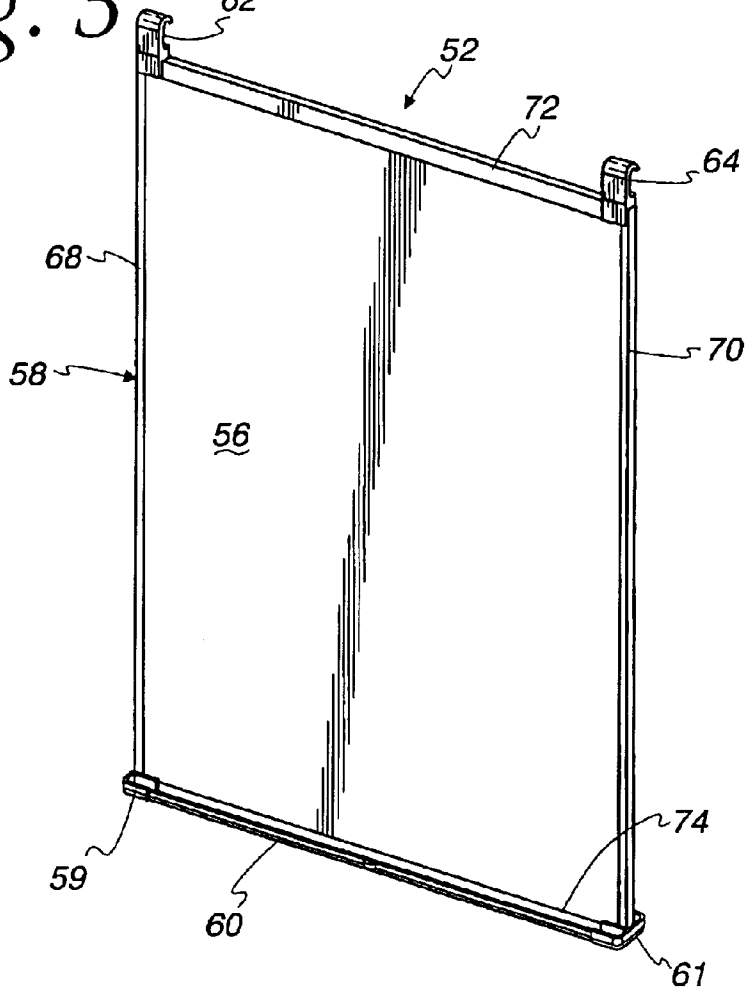
FIG. 3 is a front isometric view of the board and hook assembly.
Figure 5:
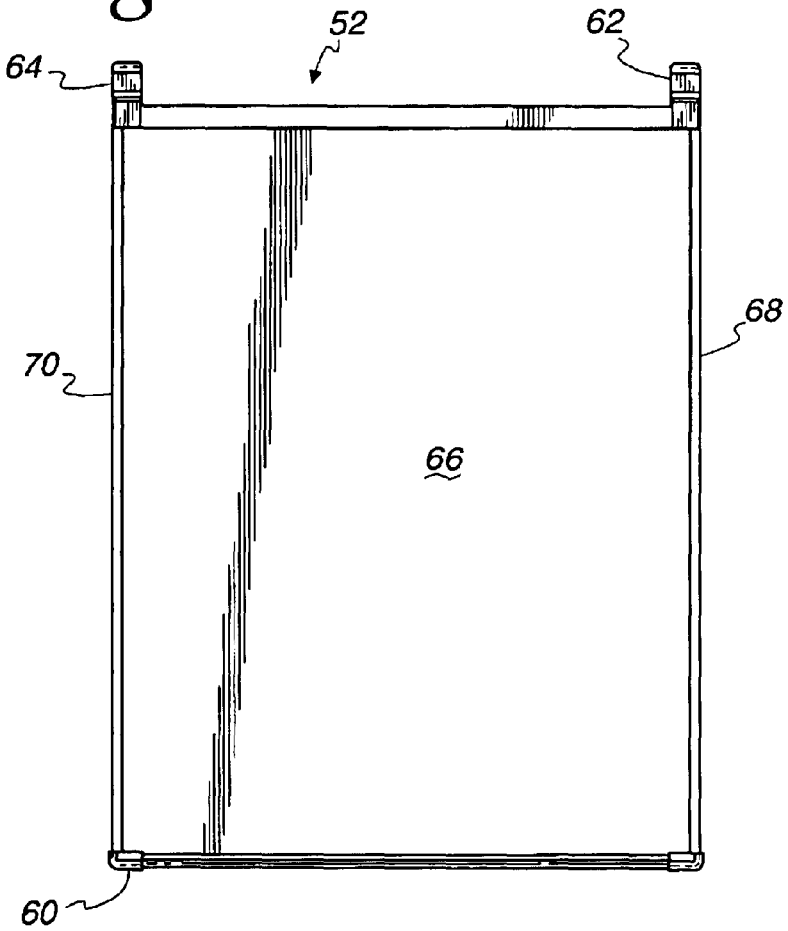
FIG. 5 is a rear elevation view of the board and hook assembly shown in FIGS. 3 and 4.
Figure 7:
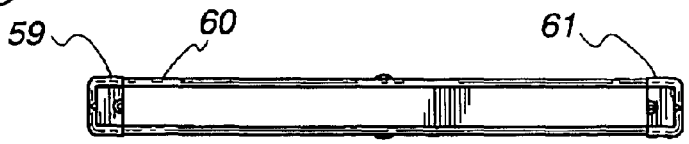
FIG. 7 is a bottom plan view of the board and hook assembly shown in FIGS. 3–6.

The hook assembly 64 also includes a detent formed by two projections 100, 102 formed on the upper surface 104 of the bracket base 92 and two recesses 106, 108 formed in a bottom surface 110 of the hook. The hook may be positioned in any rotational attitude relative to the bracket, however, when the hook is aligned with the bracket as shown in FIGS. 3–5, the recesses 106, 108 received the projections 100, 102 so that tactile and audible indications are received by the user to indicate a predetermined alignment of the hook and the bracket of the hook assembly. The hook assembly may be made of synthetic resin.

Referring now to FIGS. 10–24, the rail assembly 40 is illustrated in more detail. As described in relation to FIG. 2, the rail assembly includes a rail 46, two rail hanger brackets 42, 44 and the two rail end caps 48, 50.

Figure 12:
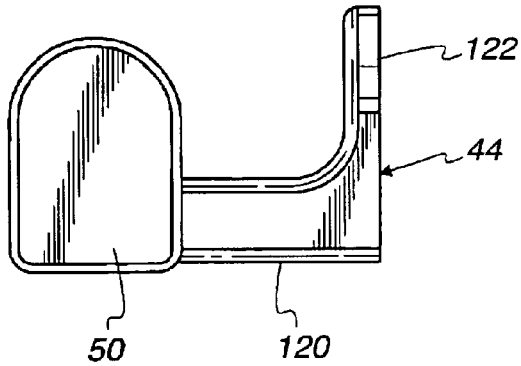
FIG. 12 is an enlarged side elevation view of the rail assembly illustrated in FIGS. 10 and 11.
Figure 13:
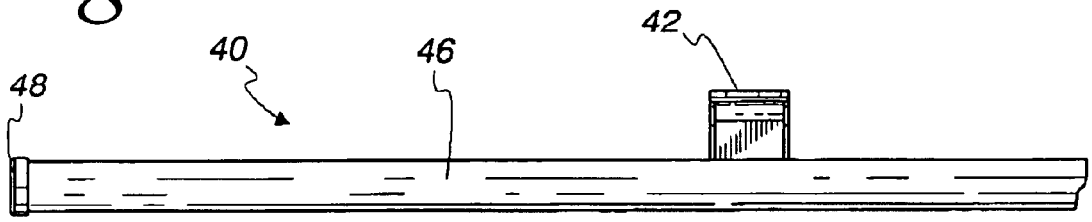
FIG. 13 is a top plan view of a portion of the rail assembly illustrated in FIGS. 10–12.
Figure 14:
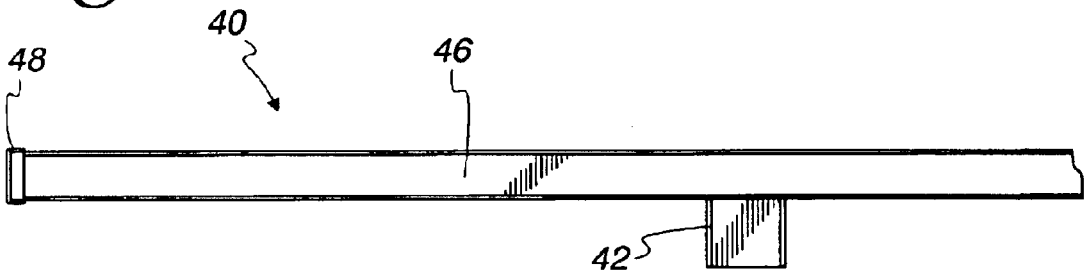
FIG. 14 is a bottom plan view of a portion of the rail assembly illustrated in FIGS. 10–13.
Figure 15:
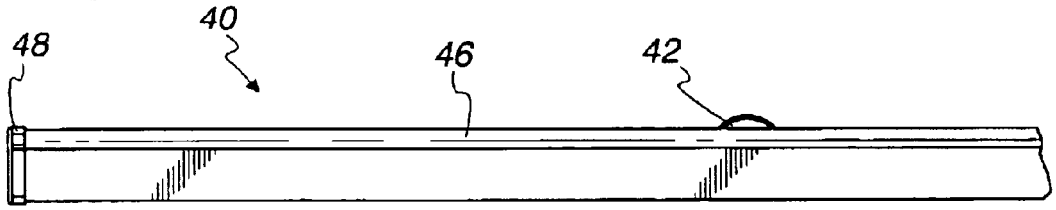
FIG. 15 is a front elevation view of a portion of the rail assembly shown in FIGS. 10–14.
Figure 16:
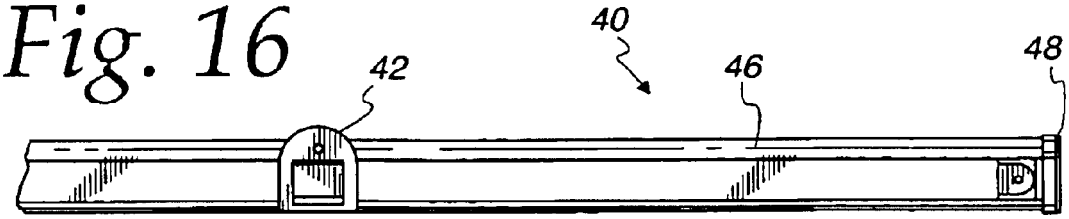
FIG. 16 is a rear elevation view of a portion of the rail assembly shown in FIGS. 10–15.
Figure 17:
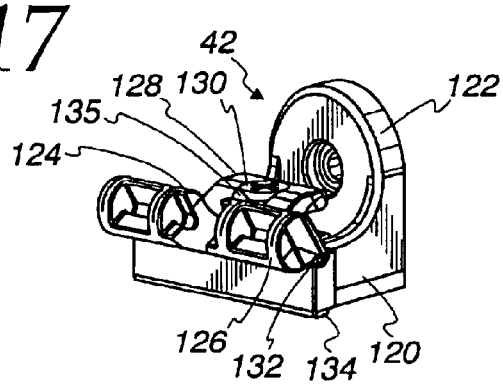
FIG. 17 is an isometric view of a rail hanger bracket.

The rail hanger bracket 42 has a generally L-shaped configuration including a horizontal leg portion 120, FIGS. 12 and 17, and a vertical wall mounting portion 122. The hanger bracket also includes two rotatable cam portions 124, 126, a handle 128 and a fastener 130. The leg portion 120 includes a curved base 132 for allowing rotation of the two cams and a projecting foot portion 134. The handle includes a slot 135 formed around the fastener whereby the handle may be moved relative to the fastener. The fastener is threaded to an opening in the leg portion (not shown) so that after the handle and cams are rotated, the fastener may be tightened against the handle to lock the handle in place. This will be explained in further detail below.

Figure 18:
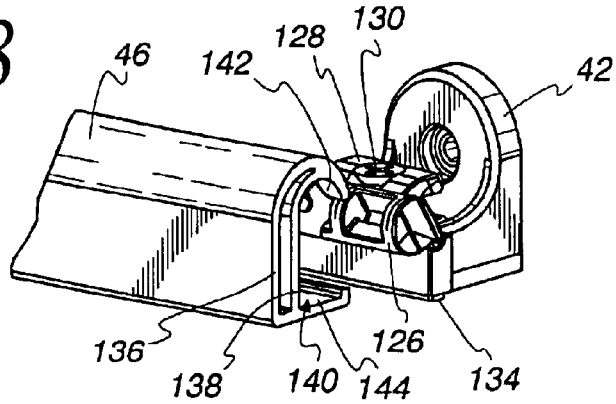
FIG. 18 is an isometric view of the hanger bracket and a rail.
Figure 19:
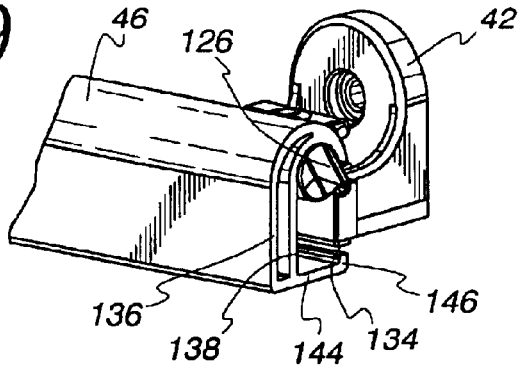
FIG. 19 is an isometric view of the rail being mounted to the rail hanger bracket.

The rail 46 has, as shown in FIGS. 18 and 19, a generally C-shaped cross section including an outer wall 136, an inner wall 138, an inner surface 140 which has a curved upper portion 142 and a generally flat lower wall 144 terminating in an upturn lip 146. The rail may be an aluminum extrusion and the hanger brackets and end caps may be formed of a zinc alloy.

Figure 20:
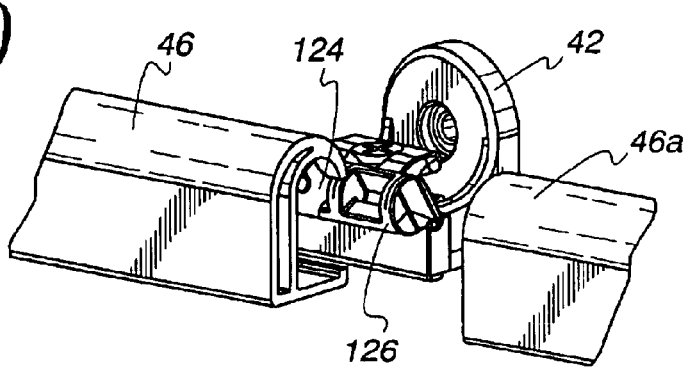
FIG. 20 is an isometric view of two rails being mounted to the rail hanger bracket.
Figure 21:
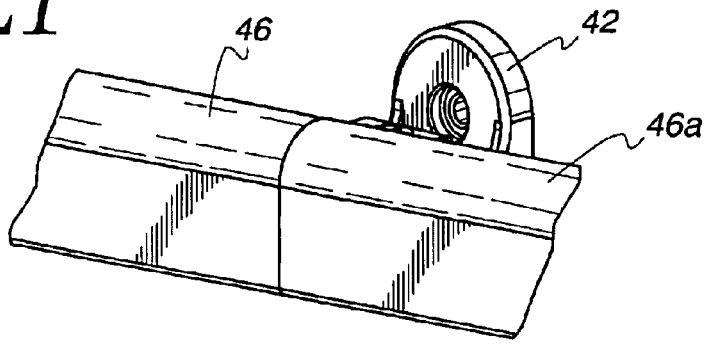
FIG. 21 is an isometric view showing the two rails mounted to the rail hanger bracket.
Figure 22:
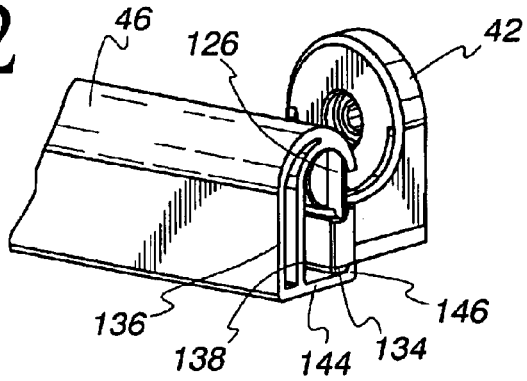
FIG. 22 is an isometric view illustrating the rail being lockingly engaged with the rail hanger bracket.

Referring to FIGS. 18–22, the operation of lockingly engaging the rail with the rail hanger bracket is illustrated in two variations. The rail generally slides over the cam portions 124, 126 of the rail hanger bracket so as to initially connect the two as shown in FIGS. 18 and 19. Alternatively, when two rails 46, 46*a* are brought together or abutted, as shown in FIGS. 20 and 21, the hanger bracket may be used as a connector as well as a supporter for the rails. Once the rail or rails are connected to the hanger bracket, the lever 128 of the hanging bracket is depressed or lowered by rotating the fastener 130 so as to rotate the cams 124, 126. This causes the cams to tightly engage the rail at the upper curved portion 142 of the interior surface 140, and the foot portion 134 of the hanger bracket tightly engages the lower wall 144 and the lip portion 146. This results in a frictional and an interference fit between the rail and the hanger bracket. To maintain the rail and the hanger bracket in a locked position, the screw fastener 130 may be rotated to press down upon the handle and lock it in the lowered position. To disassemble the rail assembly, a user merely counter-rotates the fastener and lifts the handle so that the hanger bracket cams and foot portion release the rail and the rail is allowed to slide away from the hanger bracket.

Figure 23:
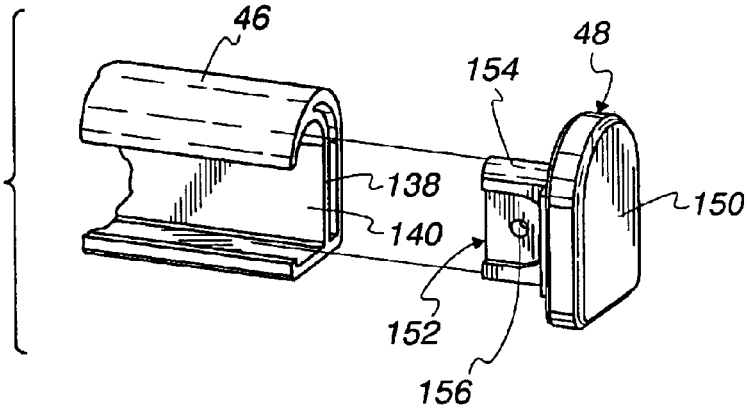
FIG. 23 is an exploded isometric view illustrating a portion of the rail and a rail end cap.
Figure 24:
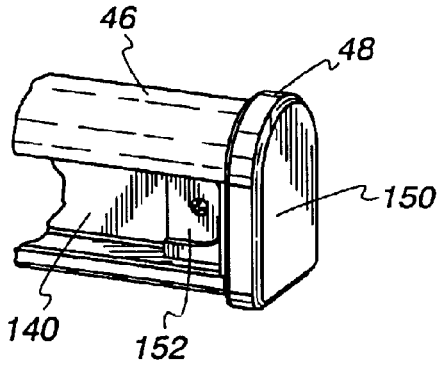
FIG. 24 is an isometric view of the rail end cap installed in the rail.

Referring to FIGS. 23, 24, the end rail cap 48 is also constructed to engage the inner surface 140 of the rail 46. The rail end cap includes an end wall 150 and a rail engaging arm 152. The engaging arm includes an outer surface 154 which complements the inner surface 140 of the rail and allows a frictional engagement between the two surfaces to result. A fastener opening 156 is also provided in the engaging arm so that a screw may be inserted to lock the end cap and the rail together by abutting or depressing the inner wall 138.

Figure 25:
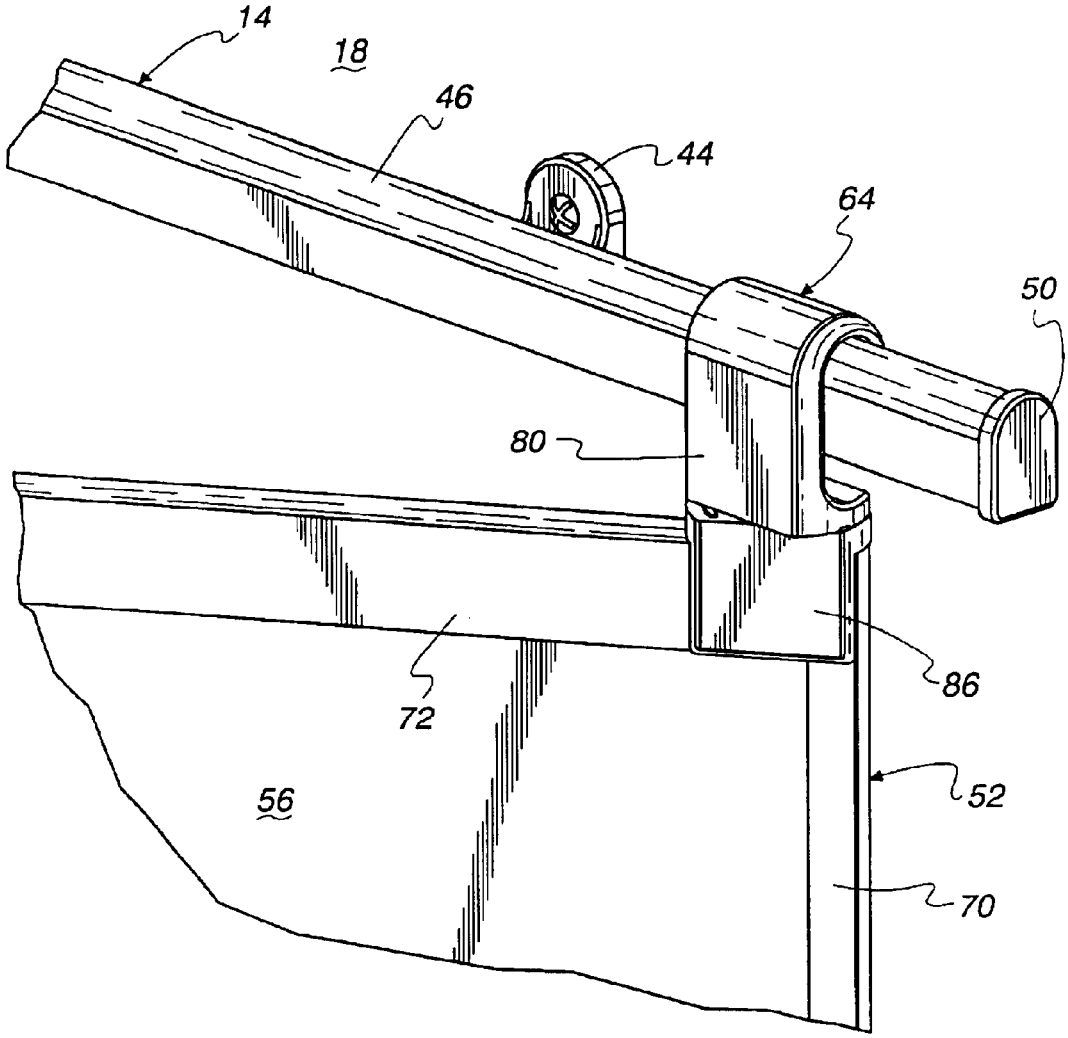
FIG. 25 is an isometric view of a portion of the board and hook assembly being mounted on the rail assembly.
Figure 26:
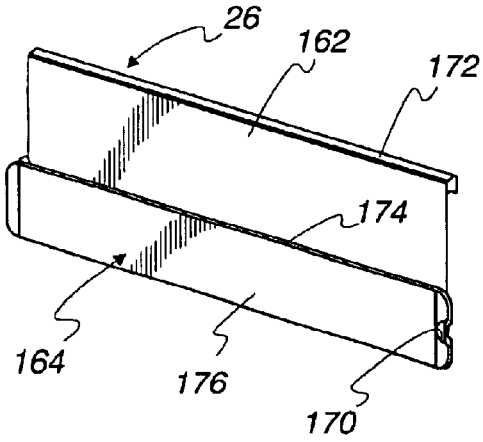
FIG. 26 is an isometric view of a flip chart holder.

Referring to FIG. 25, the operation of the hook assembly is illustrated in more detail. Once the rail assembly 14 is fastened to the wall 18, the board and hook assembly may be mounted as shown in FIG. 25 as well as in FIG. 1. FIG. 25 also illustrates the ability of the board to rotate even while the hook portion 80 of the hook assembly 64 is still mounted to the rail 46. As mentioned earlier, the rotatable hook assembly allows the board to swivel, thereby exposing both its front and rear surfaces. It is to be understood that the board may swivel one hundred eighty degrees to allow the front surface to be exchanged for the rear surface. The rotation of the hook assembly could go as high as three hundred sixty degrees if clearance is also provided. It is also to be understood that the rotational distance could be less than one hundred eighty degrees such as is shown in FIG. 25 and in FIG. 1 where rotation may stop at about forty-five degrees to allow the board 28 to straddle the intersecting walls 16 and 18.

Referring now to FIGS. 26–30, the flip chart holder 26 is illustrated in more detail. The flip chart holder is designed to support a tablet or pad 160 shown in broken line in FIGS. 27 and 28. The use of a flip chart broadens the versatility of the work board system because a user is offered the ability to use only the flip chart or the board or a combination of the two. The flip chart includes a flip chart hanging bracket 162, a door 164, a hinge 166, a latch 168 and a finger grip 170. The hanging bracket 162 includes an upper channel 172 so that the flip chart holder may conveniently hang over the top frame member 72 of the board 24. Attached to a lower portion 174 of the hanging bracket is the hinge 166 which attaches the hanging bracket 162 to the door 164.

Figure 27:
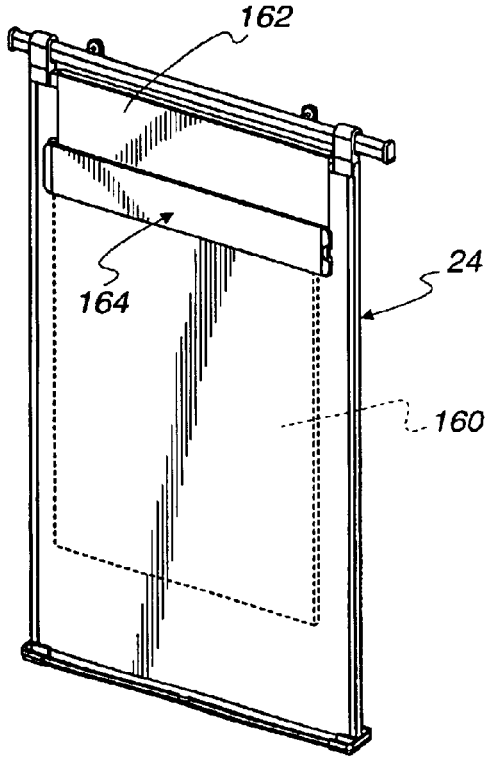
FIG. 27 is an isometric view of the flip chart holder mounted to a board and hook assembly, where the flip chart is illustrated in a closed position.
Figure 28:
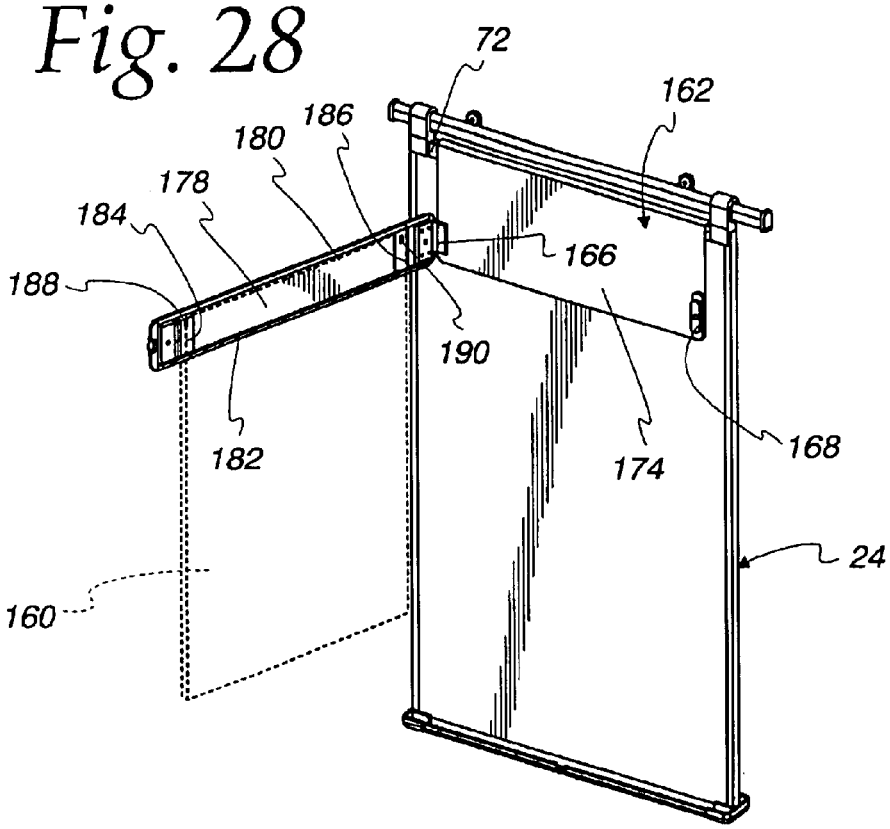
FIG. 28 is an isometric view of the flip chart holder mounted to the board and hook assembly where the flip chart holder is in an open position.
Figure 29:
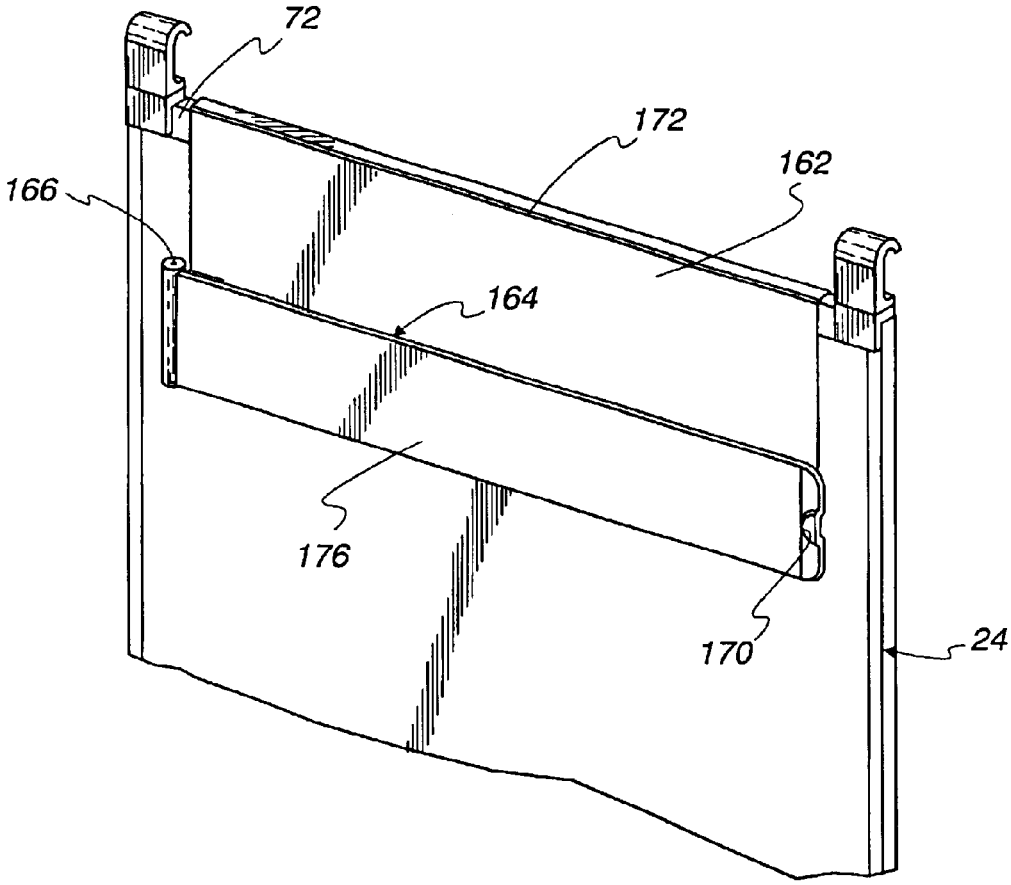
FIG. 29 is an enlarged isometric view of the upper portion of the board and hook assembly showing the mounted flip chart holder.
Figure 30:
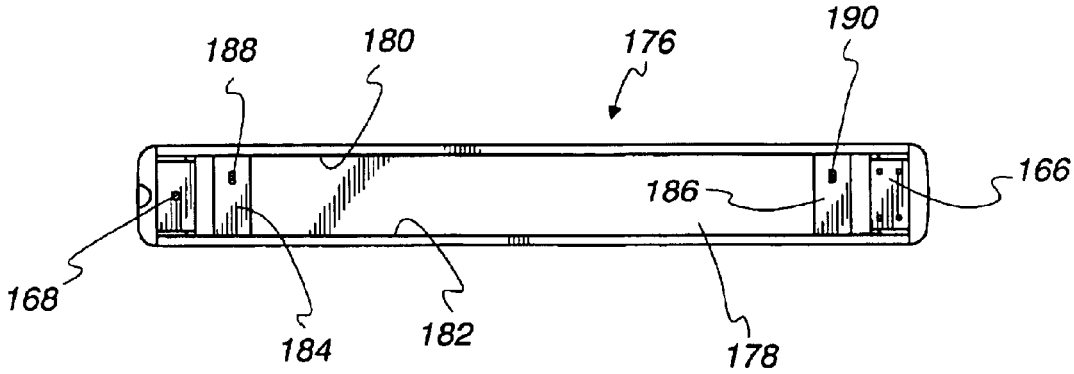
FIG. 30 is a rear elevation view of the door portion of the flip chart holder.

The door includes an outer surface 176 and an inner surface 178. As shown in FIGS. 27 and 28, the door is rotatable between a closed position shown in FIG. 27 and an open position shown in FIG. 28. Formed along the inner surface of the door are two channels, upper channel 180 and lower channel 182, and slidably captured in the channels in a direction parallel to the longitudinal axis of the door are two hook strips 184, 186. A pair of hooks 188, 190 are formed in the strips and provide an arrangement for hanging the pad 160 onto the rotating door no matter what the size or brand of the pad. The latch 168 is provided to restrain the door in its closed position.

In operation, the flip chart holder may be easily installed on or removed from a board simply by placing the flip chart hanging bracket over the top frame member 72 of the board. If the flip chart holder is to be used, a fresh pad or tablet may be installed simply by opening the door and have the pad engage the adjustable hooks 188, 190. Because the hooks slide along the door, they may be adjusted to the size of the pad mounting holes. The door may then be closed and the user may write on the pad.

The door to the flip chart holder may be opened so that the top sheet and subsequent sheets of the pad may be folded back to present a fresh sheet. When the door is returned to its closed position, the turned over sheets of the pad are maintained out of the way.

It should be noted that even when the flip chart is installed, the board and hook assembly combination may be swiveled to expose the rear surface of the board.

The above specification describes in detail several preferred embodiments of the present invention. Other examples, embodiments, modifications and variations will, under both the literal claim language and the doctrine of equivalents, come within the scope of the invention defined by the appended claims. For example, modifications to the hook assembly or the flip chart holder or the shape of the rail assembly are all considered equivalent structures and will also come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A work board assembly comprising:

a board having front and rear surfaces; and a hook assembly including a bracket attached to said board and a hook rotatably mounted to said bracket, said bracket including two arms and a base wherein said bracket straddles said board.

2. A work board assembly comprising:

a board having front and rear surfaces; and a hook assembly including a bracket attached to said board and a hook rotatably mounted to said bracket, wherein said hook assembly includes a post projecting from said hook and a post receiving opening formed in said bracket, and said hook assembly includes a biasing element for allowing said hook and said bracket to separate slightly upon an application of force and then re-engage when the force is released.

3. The work board assembly as claimed in claim 2 wherein:

said biasing element is a spring washer; and including a push nut mounted to said post.

4. A work board assembly comprising:

a board having front and rear surfaces; and a hook assembly including a bracket attached to said board and a hook rotatably mounted to said bracket, said hook assembly including a detent, and said detent also including a projection formed on one of said bracket and said hook and a recess formed on the other of said bracket and said hook.

5. The work board assembly as claimed in claim 4 wherein:

said bracket includes two arms and a base.

6. The work board assembly as claimed in claim 5 including:

a fastener opening formed in said base.

7. The work board assembly as claimed in claim 5 wherein:

said bracket straddles said board.

8. A work board assembly comprising:

a board having front and rear surfaces;

a hook assembly including a bracket attached to said board and a hook rotatably mounted to said bracket, said bracket including two arms and a base; and a fastener opening formed in said base; and wherein, said bracket straddles said board.

9. The work board assembly as claimed in claim 8 wherein:

said hook has a C-shaped cross-section.

10. The work board assembly as claimed in claim 9 wherein:

said hook assembly includes a post projecting from said hook; and a post receiving opening in said bracket.

11. The work board assembly as claimed in claim 10 wherein:

said hook assembly includes a biasing element for allowing said hook and said bracket to separate slightly upon an application of force and then re-engage when the force is released.

12. The work board assembly as claimed in claim 11 wherein:

said biasing element is a spring washer; and including a push nut mounted to said post.

13. A work board assembly comprising:

a board having front and rear surfaces; and a hook assembly including a bracket attached to said board and a hook rotatably mounted to said bracket, and wherein said hook assembly includes a detent, said bracket includes two arms and a base, said hook assembly includes a post projecting from said hook and a post receiving opening in said bracket, and said hook assembly includes a biasing element for allowing said hook and said bracket to separate slightly upon an application of force and then re-engage when the force is released.

14. A work board assembly comprising:

a board having front and rear surfaces;

a hook assembly including a bracket attached to said board and a hook rotatably mounted to said bracket; and a flip chart holder removably mounted to said board, said flip chart holder having a flip chart hanger bracket, a door, a hinge connecting said hanger bracket and said door, a latch for restraining said door, and a pair of hooks adjustably mounted on said door for supporting a flip chart.

15. The work board assembly as claimed in claim 14 wherein:

said door includes an inner surface having upper and lower grooves, said pair of hooks being connected to strips engaged to said upper and lower grooves for allowing said strips to move as a function of the size of a supported flip chart.

16. The work board assembly as claimed in claim 15 wherein:

said flip chart holder includes a finger grip allowing a user to rotate said door about said hinge.

17. A work board assembly comprising:

a board having front and rear surfaces, each of said front and said rear surfaces being usable for marking or tacking;

a hook assembly including a bracket attache to said board and rotatably mounted to said bracket wherein said board includes a frame and a tray; and a flip chart holder removably mounted to said board, said flip chart holder having a flip chart hanger bracket, a door, a hinge connecting said hanger bracket and said door, a latch for restraining said door, and a pair of hooks adjustably mounted to said door for supporting a flip chart.

18. The work board assembly as claimed in claim 17 wherein:

said door includes an inner surface having upper and lower grooves, said pair of hooks being connected to strips engaged to said upper and lower grooves for allowing said strips to move as a function of the size of a supported flip chart.

19. The work board assembly as claimed in claim 18 wherein:

said flip chart holder includes a finger grip allowing a user to rotate said door about said hinge.

20. A work board assembly comprising:

a board having front and rear surfaces, a frame and a tray; and a hook assembly including a bracket attached to said board and a hook rotatably mounted to said bracket, said hook assembly including a detent, said detent includes a projection formed on one of said bracket and said hook and a recess formed on the other of said bracket and said hook.

21. The work board assembly as claimed in claim 20 wherein:

said bracket includes two arms and a base;

a fastener opening is formed in said base; and said bracket straddles said board.

22. The work board assembly as claimed in claim 21 wherein:

said hook has a C-shaped cross-section.

23. The work board assembly as claimed in claim 22 wherein:

said hook assembly includes a post projecting from said hook and a post receiving opening in said bracket.

24. The work board assembly as claimed in claim 23 wherein:

said hook assembly includes a biasing element for allowing said hook and said bracket to separate slightly an application of force and then re-engage when the force is released.

25. The work board assembly as claimed in claim 24 wherein:

said biasing element is a spring washer; and including a push nut mounted to said post.

26. A work board for mounting on a rail comprising:

a board having front and rear surfaces;

a structure for connecting said board to a rotatable hook; and a flip chart holder removably mounted to said board, said flip chart holder having a flip chart hanger bracket, a door, a hinge connecting said hanger bracket and said door, a latch for restraining said door, and a pair of hooks adjustably mounted to said door for supporting a flip chart.

27. The work board as claimed in claim 26 wherein:

said door includes an inner surface having upper and lower grooves, said pair of hooks being connected to strips engaged to said upper and lower grooves for allowing said strips to move as a function of the size of a supported flip chart.

28. The work board as claimed in claim 27 wherein:

said flip chart holder includes a finger grip allowing a user to rotate said door about said hinge.

29. The work board as claimed in claim 28 wherein:

said structure includes a frame and a bracket.

30. The work board as claimed in claim 29 wherein:

each of said front and said rear surfaces is usable for marking or tacking.

* * * * *